United States Patent [19]

Wells

[11] 4,405,453

[45] Sep. 20, 1983

[54] PROCESS FOR CLEANING UNDESLIMED COAL

[75] Inventor: Charles H. Wells, Portola Valley, Calif.

[73] Assignee: Envirotech Corporation

[21] Appl. No.: 351,384

[22] Filed: Feb. 23, 1982

[51] Int. Cl.[3] ..... B03B 5/34

[52] U.S. Cl. ..... 209/172.5; 364/502

[58] Field of Search ..... 209/1, 39, 172.5; 364/502

[56] References Cited

U.S. PATENT DOCUMENTS

| | | | |
|---|---|---|---|
| 3,093,577 | 6/1963 | Wilmot | 209/172.5 |
| 3,235,072 | 2/1966 | Nelson | 209/172.5 X |
| 3,246,750 | 4/1966 | Chase et al. | 209/172.5 X |
| 3,247,961 | 4/1966 | Chase et al. | 209/172.5 X |
| 3,282,417 | 11/1966 | Chase et al. | 209/172.5 X |
| 4,028,228 | 6/1977 | Ferris et al. | 209/172.5 X |

FOREIGN PATENT DOCUMENTS

| | | | |
|---|---|---|---|
| 984355 | 2/1965 | United Kingdom | 209/172.5 |

*Primary Examiner*—Ralph J. Hill
*Attorney, Agent, or Firm*—R. E. Krebs

[57] ABSTRACT

A process for cleaning undeslimed coal includes the steps of determining the scalar value of cross-correlation function of the measured values of the percent magnetics and the bulk specific gravity of a heavy media and coal slurry being fed to a cyclone, comparing the value to a set-point value determined after start-up when the recirculating suspension in the feed slurry is normally clean, and diverting at least a portion of the heavy media suspension that is separated from the underflow of the cyclone from being mixed with the feed coal slurry, to thereby correspondingly reduce the slime content of the feed slurry, and concurrently increasing the flow of cleaner heavy media suspension to the feed coal slurry until the cross-correlation function is brought up to the set-point value. Also disclosed is an embodiment of the process for cleaning coal, wherein the overflow from the cyclone is screened and screened solution is split between a first recycle loop for cleaning the suspension and the heavy media sump. Similarly, the underflow from the cyclone is screened and then split between a separate recycle loop and the heavy media sump. Suspension is diverted to the heavy media sump from one or both recycle cleaning loops as necessary. The remaining portions of the split suspension flows from the two screening devices are, in turn, respectively split between two further sumps and the heavy media sump, with more suspension coming from the cyclone overflow screen when cleaner suspension is indicated as being necessary by the aforesaid statistical analysis.

2 Claims, 1 Drawing Figure

PROCESS FOR CLEANING UNDESLIMED COAL

BACKGROUND OF THE INVENTION

This invention relates to a process for cleaning coal. More particularly, the present invention concerns a process for cleaning coal containing shale or clay slimes (such coal being referred to hereinafter as undeslimed coal), wherein the undeslimed coal is mixed with a magnetic heavy media suspension such as magnetite and the three phase slurry of coal, magnetite and water is fed to a cyclone to separate the coal from nonbituminous material, such as ash.

Examples of prior art processes that utilize heavy media separation aids are shown and described in U.S. Pat. Nos. 3,282,417, 3,247,961 and 3,246,750, all to Chase et al. The 3,282,417 patent discloses a method of controlling the cleanness of the heavy media suspension that is recirculated in the separation process. The method includes the steps of measuring both the specific gravity of the suspension and the content of magnetic particles therein at a location representative of the vessel, developing a signal proportional to the difference between the specific gravity and the content of magnetic particles, which signal is representative of the content of contaminants, introducing water to said vessel in volumes which vary with said signal to maintain a relatively constant set content of contaminants in the suspension within said vessel, and adjusting the content of magnetic particles in the suspension entering said vessel after the water volume changes, thereby compensating for changes in the specific gravity of the suspension brought about by variations in the water volume, and maintaining the specific gravity of the suspension within said vessel at a relatively constant set value.

Significant problems can occur in this prior art process due to the inherent inaccuracies, noise and drift characteristics, and varying gains or sensitivities of the magnetic sensor and the density sensor. When considerable slimes are present in the mineral mixture to be separated, the relatively simple procedure of subtracting the values of the signals from the two sensors can produce such erroneous readings that the solid-solid separator used in the process may operate with relatively erratic efficiencies. It is important to note that efficiency of a cyclone type of solid-solid separator is particularly sensitive to small changes in viscosity of the three-phase slurry of coal, magnetite and water that can be brought about by shale or clay slimes. Thus, it is important that any discrepancies inherent in the specific gravity and the magnetite level instrumentation, such as noise drift, any differences in gain or sensitivities of the two sensors and any difference in relative accuracies of the two sensors, be reduced.

It is also important in a cyclone type of heavy media separation process to sense the heavy media suspension level and provide additional media (magnetite) to the feed stream to the cyclone quickly upon indication that the media level is different from a set value.

SUMMARY OF THE INVENTION

The coal cleaning process of the present invention contemplates the continuous measurement of both the content of magnetic particles and the density of the three-phase feed slurry being directed to a cyclone and the statistical analysis of the density and magnetite levels to assure that the cyclone is operated at maximum efficiency, thereby maximizing the production of clean coal. According to the preferred embodiment of the present invention, a suspension of heavy media is either recirculated within a loop including the refuse dilute media sump of the coal cleaning system and the separator for separating the media from slimes, or the mixture is fed to a heavy media sump for admixture into the coal feed stream. The signals from a magnetic sensor and a specific gravity sensor are collected and stored over a period, such as 20 minutes, and at a time when it is known that the slime content of the media suspension is normally lowest, such as immediately after starting operation of the coal cleaning system. At such time it has been found that the value of the cross-correlation function between the two signals will have its highest scalar value. Such highest value is then taken as being indicative of a set-point whereat the viscosity of the three-phase slurry being fed to the cyclone is appropriate for maximum efficiency of separation in the cyclone. Concurrently, a statistical analysis of the density and percent magnetic signals is made at a selected frequency, such as at one minute intervals, using the historically evolved value of the cross-correlation function, to determine the cleanness of the slurry. If the current value is less, the suspension of media is diverted from the heavy media sump to the refuse dilute media sump.

In the preferred embodiment, the the overflow from the cyclone is processed through a loop that includes another magnetic separator for separating media from the overflow. This loop, hereinafter called the clean coal dilute recycle loop (in contrast to the aforementioned refuse dilute media recycle loop) may include a clean coal dilute sump and a divertor in the line from the magnetic separator to the clean coal dilute sump. The divertor can direct greater flow into a line extending to the heavy media sump when additional clean (deslimed) media suspension is needed. The media separated from the cyclone underflow is directed through yet another divertor arrangement to the heavy media sump and the clean coal dilute sump, dependent on the position of such divertor. When the slurry being fed to the cyclone is determined by the basic process to be contaminated, as described above, the divertors directly associated with the cyclone underflow and overflow are set to circulate separated media suspension at a higher rate to the recycle loops. It is noted that the magnetic separators of both loops are equally efficient, but the underflow from the cyclone normally contains more slimes. This divertor arrangement is advantageous because it permits the four divertor arrangements to be operated below their saturations states, with a greater flow rate of separated heavy media suspension being diverted to the heavy media sump from the cyclone overflow stream than from the cyclone underflow stream. This divertor and recycle loop arrangement maximizes control responsiveness and minimizes the possibility of temporary loss of cleanness control.

FIG. 1 is a simplified flowsheet illustrating the coal cleaning process of the present invention.

DESCRIPTION OF THE PREFERRED EMBODIMENT

Figure 1:
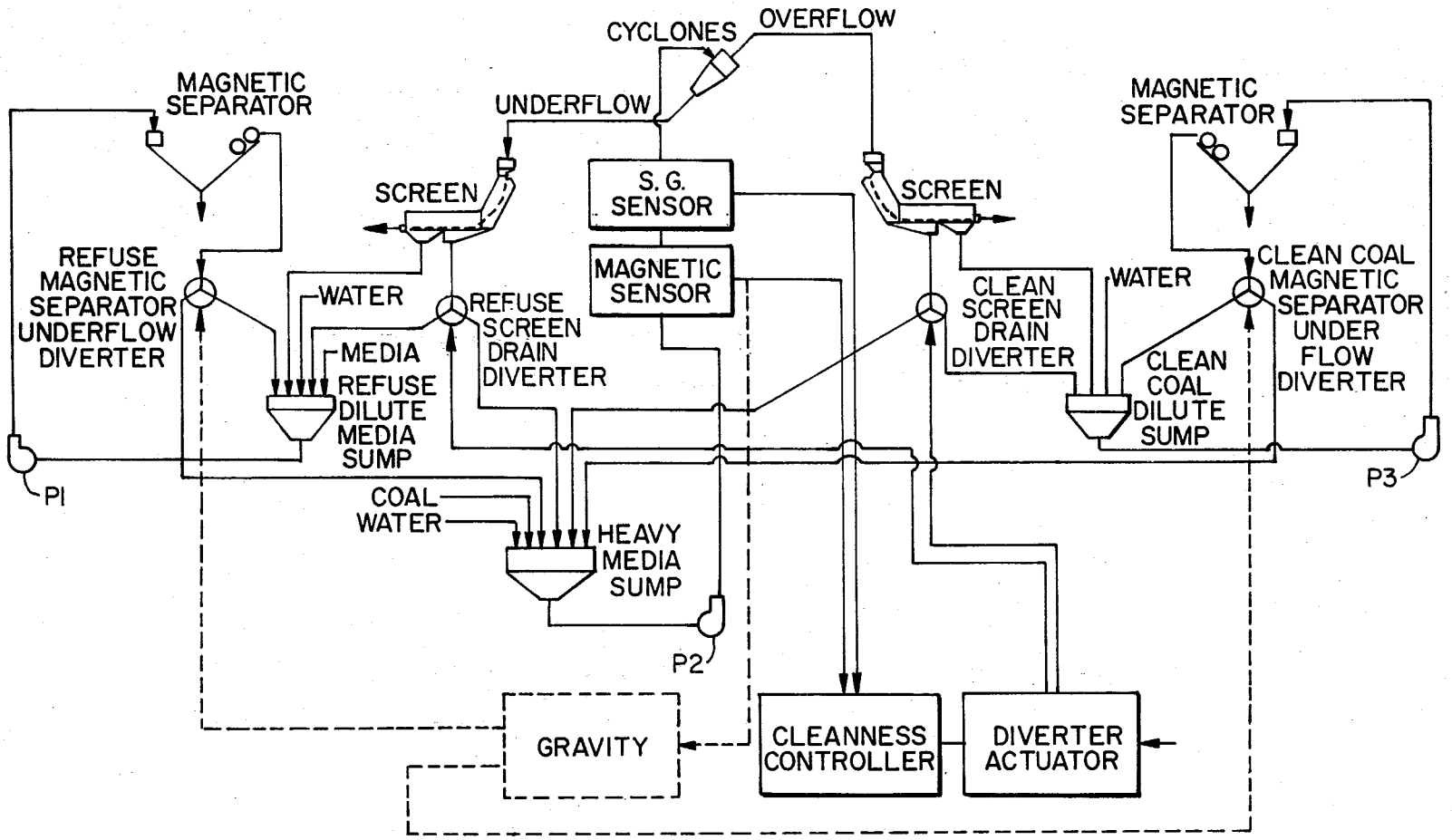

The essential elements of the control strategy of the present invention include: (1) measuring the percent magnetics in the feed slurry to a cyclone directly with a magnetic coil, and then adjusting the amount of clean magnetic material returned to the heavy medium slurry; and (2) estimating the viscosity of the slurry by simultaneously measuring the percentage of magnetic material in the slurry and its bulk specific gravity, performing a statistical calculation between these two signals to estimate the cleanness of the slurry, followed by closed-loop control of the cleanness by means of adjusting the amount of material bled from the screened underflow and over-flow from the cyclone.

A simplified process flowsheet is shown below in FIG. 1. Coal is fed to the process by means of a conveyor from a raw coal crusher (not shown on the simplified flowsheet). The feed material is directed to the heavy medium sump with the aid of recycled water from a static thickener and material from the drain sections of the illustrated process screens. The amount of material returned to the heavy medium sump is controlled by means of two three-way diverter values. These diverter valves are shown on the simplified flowsheet directly below the screens.

The amount of clean (deslimed) magnetic material returned to the heavy medium sump is controlled by a similar diverting arrangement for the respective overflows from two dual-drum type magnetic separators. A splitter box was installed on the overflow lines from the magnetic separators. The fraction of material returning to the heavy medium sump is controlled by means of a divertor including linear air motor modulater by a signal from a specific gravity controller. The overflows from the magnetic separators is thus split between the heavy medium sump and clean coal dilute sump and the refuse dilute sump. The diverter valves are also shown in the single FIGURE directly below the magnetic separators. The two magnetic separators receive feed material from the refuse dilute sump and clean coal dilute sumps respectively.

The heavy medium sump thus receives returning streams from the two magnetic separators and also the underflow from the drain sections of the two process drain and rinse screens. Additional magnetite is added to the refuse dilute media sump on a batch basis as required to maintain bulk specific gravity when the percent magnetics control system is unable to maintain its set point; i.e., when the diverters associated with the magnetic separators are returning all clean magnetite to the heavy medium sump.

The three-phase mixture of coal, magnetite and water is fed to the separating cyclone by means of a pump. The mixture is delivered to the cyclone at a constant pressure.

The bulk specific gravity is measured by means of a nuclear density sensor, called S. G. Sensor in FIG. 1, located on the cyclone feed line. The percentage of magnetite particles was measured by means of a magnetic coil device also located on the feed tube. This is denominated in a magnetic sensor in the drawing. The percent magnetics signal is used directly in a feedback control loop, shown in dashed outline, to adjust the position of the diverters in the overflow lines from the two magnetic separators. There are two outputs from the control loop, one to each diverter mechanism.

The signals from the magnetic sensor and the specific gravity sensor are processed by an autocorrelating mechanism incorporated in the cleanness controller. A deadtime-compensated diverter actuator receives an output signal from the cleanness controller and produces two outputs: one to the refuse screen drain diversion valve arrangement and the other to the clean screen drain diversion valve arrangement.

In order to understand the basic concept of the present invention, the following should be considered. Assume that both the percent magnetics and the nuclear density sensors generate repeatable information; i.e., the sensors may not be accurate or corrected for noise or drift, etc. but both produce the same readings whenever the true percent magnetics and bulk specific gravities are the same as at some previous time. The instruments are then said to have a certain repeatability. In a perfect three-phase mixture (water, magnetite, particles, and coal), as the percent magnetics increases so does the bulk specific gravity; and furthermore it does so in a deterministic manner as calculated from a material balance. Suppose that the percent magnetics remains constant while the slurry density increases at constant coal feed rate. The increase in slurry density is due to an increase in the volume percent of nonbituminous material (i.e., clay or shale slimes). If the slurry feed is clean, then the percent magnetics and the specific gravity signal should track each other. It is to be taken that a clean slurry is defined as having a constant ratio of slimes, coal, magnetite, and water. As indicated above, this condition will never exist in a preparation plant. In the aforementioned Chase et al U.S. Pat. No. 3,282,417, it is disclosed that a "cleanness signal" can be generated by taking the difference between magnetics and specific gravity signals and then using this difference signal for control purposes. However, due to noise and electronic drift problems inherent in all process control instrumentation, a deterministic calculation of the cleanness of the slurry is not felt to be practical in the coal cleaning art. To develop a reliable signal for purposes of providing optimally efficient operation of a cyclone, and an incremental increase in efficiency justifying a statistical analysis of the derived signals.

Random variations of time-dependent processes are taken into account to use the cross-correlation function as a measure of the degree of tracking of the two signals. For example, if the scalar valve of the cross-correlation function is large, then the signals are said to be tracking each other in a statistical sense; and if the cross-correlation function is near zero, then there is little relationship between the two signals.

The cross correlation function is defined over an infinite window of historical data from two signal sources as:

$$R(\tau) = \int_{-\infty}^{+\infty} x(t)\, y(t-\tau)\, dt$$

where ($\tau$) represents the time shift, if any, between the two signal generation processes, $R(\tau)$ is the cross-correlation function value at a delay ($\tau$), x(t) is the specific gravity signal at time (t), and $y(t-\tau)$ is the percent magnetics signal at the time (t).

An interesting property of this function is that at $\tau=0$, (where $\sigma$ is the standard deviation), $$R(O) = \frac{\sigma_{xy}^2}{\sigma_x \sigma_y}$$

that is, the correlation coefficient between the two signals.

Although the correlation function is defined over an infinite time frame, a finite data set can be used with an inappreciable loss in accuracy. A good approximation to $R(\tau)$ is as follows:

$$R(\tau) = \int_{-T}^{O} \times (t)\, y\,(t - \tau)\, dt$$

where T represents the history length over which the calculation is performed. Historical records of both the specific gravity and the percent magnetics are required to perform the calculation. Process data can be stored and the calculations indicated in Equation (4.3) determined in a microprocessor contained the cleanness controller.

The signal generated by Equation (4.3) is used in a deadtime-compensated divertor actuator to modulate the diverter valve positions in the bleed lines from the screen drain sections. Two outputs from the controller are determined by the control algorithm: one output is to the clean coal screen bleed diverter and the other is to the refuse screen bleed diverter. The signals remain at the ratio they held when the system was in manual control immediately after start-up until one of the diverter positions saturates, then the ratio becomes directly controlled by the remaining stroke of the independent diverter.

The cleanness controller makes a "bumpless" transfer to automatic from manual control. To determine the set-point, the operator first operates the coal cleaning plant with "clean slurry" for at least twenty minutes prior to switching to automatic control. Thus, when the control system is subsequently operated automatically, the set-point for cleanness is derived and stored in the computer system. Once under automatic control, the operator need not adjust the set-point to obtain the optimum yield. This process could also incorporate an on-line ash measurement so that the yield can be computed and displayed in real-time if desired.

Within the specific gravity controller (dashed outline), the percent magnetics signal is converted from an analog signal to a digital signal, and the digitized signal is processed through a digital filtering algorithm that includes exponential filtering followed by a "burst" filter (non-linear clipping) to remove large rapid spurious signal excursions. The processed signal is fed to the dead-time compensated divertor actuator that determines the required amount of movement of the diverter motors on the magnetic seperator underflow lines. The ratio between the clean and the refuse diverter positions on manual control is maintained until one of the diverters saturates; thereafter, the ratio is determined by the position of the independent diverter.

The cleanness controller uses both the percent magnetic and the specific gravity signals to estimate the cleanness of the three-phase slurry feed to the cyclones. Both signals are first conditioned prior to being directed to the cross-correlation function. The correlation is performed over the last N minutes of data, where N is determined in the field. In one example a 20 minute window of past data was used to compute the correlation function. Although up to 25 lags of the function were computed, high correlations occurred only at lags of less than 10 minutes.

It will be seen in FIG. 1 that water may be added to the sumps, as necessary. Water may be added to the refuse dilute media sump or to the clean coal dilute sump to assure proper flow conditions in the respective recycle loops.

It will be also seen in FIG. 1 that the media suspension is circulated within the refuse recycle loop by a pump P1. Similarly, the suspension is recycled in the clean coal recycle loop by a pump P3. The feed slurry is pumped from the heavy media sump to the cyclones by pump P2.

Although the best mode contemplated for carrying out the present invention has been herein shown and described, it will be apparent that modification and variation may be made without departing from what is regarded to be the subject matter of the invention.

What is claimed is:

1. An improved process for cleaning a coal mixture to remove ash particles and slime particles therefrom, wherein the mixture is fed to a cyclone to separate the mixture into an overflow fraction containing coal mixture and slime particles and an underflow fraction including ash particles and slime particles, and wherein a magnetic heavy media suspension such as magnetite and water is mixed with the coal mixture to enhance separation within the cyclone, the improvement comprising sensing the bulk specific gravity of the feed mixture containing the coal and heavy media suspension being fed to the cyclone, sensing the percentage magnetic material in said feed mixture, deriving a set-point value of the cross-correlation function of sensed values of the percentage of magnetic materials and the specific gravity at points in time immediately subsequent to start-up, continuously separating heavy media suspension from the underflow fraction from the cyclone, continuously mixing a portion of separated suspension with further coal mixture to be cleaned, generally continuously determining the value of cross-correlation function of the feed mixture containing the separated suspension, and reducing the portion of the separated suspension mixed with further coal when the subsequently determined value is less than the set-point value to thereby correspondingly reduce the slime content of the feed mixture.

2. The process according to claim 1, further including the steps of separating heavy media suspension from the overflow fraction, mixing a portion of the last-mentioned separated suspension with further coal to be cleaned, and generally concurrently with the step of reducing the portion of the first-mentioned separated media suspension, mixing a relatively greater amount of the last-mentioned separated portion with further coal mixture to be cleaned.

* * * * *